United States Patent [19]

Wright et al.

[11] 4,445,799

[45] May 1, 1984

[54] DOCUMENT HOLDERS

[75] Inventors: David M. Wright, Shrewsbury; Albert G. Ermanski, Auburn, both of Mass.

[73] Assignee: Wright Line Inc., Worchester, Mass.

[21] Appl. No.: 234,072

[22] Filed: Feb. 12, 1981

[51] Int. Cl.[3] ..... B42F 13/00; B42F 15/00; A47B 63/00

[52] U.S. Cl. ..... 402/4; 281/15 A; 281/21 R; 312/183; 312/184; 402/73; 402/80 P; 402/80 R; 402/74

[58] Field of Search ..... 281/15 A, 21 R; 402/73, 402/74, 80 P, 38, 4; 312/343, 328, 184, 183; 211/169, 165; 248/257, 258

[56] References Cited

U.S. PATENT DOCUMENTS

| | | | |
|---|---|---|---|
| 3,066,680 | 12/1962 | Duncan | 402/74 |
| 3,801,175 | 4/1974 | Guilie | 312/184 |
| 3,957,321 | 5/1976 | Rose | 312/184 |
| 4,056,296 | 11/1977 | Hedstrom et al. | 312/183 X |
| 4,208,146 | 6/1980 | Schudy | 402/80 R X |
| 4,285,555 | 8/1981 | Hedstrom et al. | 402/4 X |
| 4,306,736 | 12/1981 | Cournover et al. | 402/80 P X |

FOREIGN PATENT DOCUMENTS

| | | |
|---|---|---|
| 1058735 | 10/1964 | United Kingdom . |
| 1145705 | 3/1969 | United Kingdom . |
| 1146237 | 3/1969 | United Kingdom . |
| 1204504 | 9/1970 | United Kingdom . |
| 1486855 | 9/1977 | United Kingdom . |
| 1534889 | 12/1978 | United Kingdom . |

*Primary Examiner*—Paul A. Bell

*Attorney, Agent, or Firm*—Milton E. Gilbert; Gary E. Ross

[57] ABSTRACT

A document holder for releasably binding together loose-leaf stationery items and securing them to either single- or double-rail suspension filing systems is provided by a loose-leaf binder which incorporates a thin external spine structure incorporating at least one hook suitable for suspending the binder from single-rail suspension systems and retractable head- and tail-end hooks suitable for use with double-rail suspension systems.

13 Claims, 5 Drawing Figures

DOCUMENT HOLDERS

BACKGROUND OF THE INVENTION

This invention relates to document holders, and more particularly to binders for loose-leaf materials designed for binding and filing documents and other sheet-like materials in suspension filing systems.

Holders for loose-leaf materials, and in particular document holders designed to releasably bind such materials together and support the bound items in suspension filing systems are well known. For example, see U.S. Pat. No. 4,171,854 and the references cited therein. The document holder shown in U.S. Pat. No. 4,171,854 is basically in the form of a post binder, the spine of which is provided with integral hook means for mounting the holder to a suitable support hanger of a suspension filing system. Provision is made for securing the binder to either a top-loading two-rail suspension system or a side-loading single-rail suspension system. For the former type system, fixed support hooks are provided extending beyond the head- and tail-ends of the spine of the binder. For the latter type suspension system (the so-called "center rail" file), one or more hooks are recessed into the rear of the spine. As is typical with a post binder, the documents are secured to the binder by placing marginal apertures in the document over a series of posts or pins which project from one of the two halves of the binder and locking the other half of the binder to the first so as to captivate the posts.

It will be appreciated that the presence of fixed hooks projecting beyond the head- and tail-ends of the spine prevents a document bound in such a holder from being easily shelved as a conventional book. To overcome such problems, post binders incorporating retractable end hooks, such as disclosed in U.S. Pat. No. 3,801,175, are also known. In this last cited patent, the retractable end hooks are slidably mounted within the case of a post-style binder, and are held captive by the posts nearest the head- and tail-ends.

While such post-style binders are convenient for the storage of such stationary items as accounting summaries and the like, which may be added to seriatum, they are not convenient for the storage of loose-leaf documents which are subject to periodic extensive revision, in that intercalation is difficult. Loose-leaf notebooks incorporating a standard multi-ring mechanism overcome this problem, in that they readily permit the removal and insertion of pages within a document without requiring any other page to be removed.

Additionally, it should be noted that the two styles of suspension file require the filed document to be differently labeled for easy access. Thus, the two-rail suspension file is typically top loaded, with the spine of the post binder upermost, and accordingly is preferably labeled on the rear of the spine. On the other hand, the single-rail suspension file is typically side loaded, again with the spine of the bound item upermost, and is thus best labeled along the head edge of the document. In the prior art, such labels have typically been affixed to a portion of the spine. It will be appreciated that such a label extending from the spine along the head edge of the document would likely interfere with the operation of a retractable end hook recessed within the case. On the other hand, incorporating such a label into the retractable end hook would result in an awkward end hook.

It should also be noted that the retractable end hooks in some designs are not provided with means for securing them in the extended position. Such end hooks are subject to accidental retraction, as by hitting the end hook end-on against a rail of the suspension file system while filing the binder.

Finally, it will be appreciated that retractable hooks captivated by the posts of a post binder require the binding mechanism to be opened, with the possible loss of order of the bound document, in order to replace a broken hook.

Accordingly, it is an object of the present invention to provide a multi-ring binder adapted to be filed in a suspension filing system.

Yet another object of the invention is to provide a multi-ring binder with retractable end hooks, for use with double-rail suspension filing systems, and with recessed hook means for use with single-rail suspension filing systems.

Still another object of the invention is to provide a multi-ring binder with retractable end hooks and a head-end edge label.

A further object of the invention is to provided such a filing system with retractable end hooks which may be releasably secured in both closed and opened positions and which, although captivated to the binder, may be easily replaced without the need of removing documents from the binder.

BRIEF DESCRIPTION OF THE INVENTION

These and other objects are met in the present invention of a multi-ring loose-leaf notebook in which a thin spine structure provides, in effect, a false back to the binder's case. This spine structure incorporates a recessed hook for single-rail suspension systems and snap-in retractable head- and tail-end hooks, suitable for use with a double-rail suspension system, which fit drawer-like into recesses provided in the head- and tail-end of the spine structure.

Preferably, the spine structure is a separate assembly which fits onto a specially designed binder case. A special feature of the invention resides in ribs internal to the case so designed as to prevent the multi-ring mechanism from lateral spreading under compressive loads. This feature permits the multi-ring mechanism to function as a reinforcing member. This permits the spine structure to be relatively thin, as a consequence of which the binder may be opened relatively flat, facilitating its use.

The rear of the spine structure is provided with a label, useful in accessing the binder in top-loading suspension files and in conventional library shelving. The head end of the spine structure adjacent the case and clear of the recess accommodating the retractable head-end hook may be provided with a secondary label holder useful in side-loading suspension filing. It will be appreciated that this secondary label holder may project from the spine structure in the plane of the head edge of the case, and therefore not interfere with either the retractable hook, the suspension file, or the operation of the binder.

The retractable end hooks are releasably captivated by resilient spring catches and stops cooperating with a series of detents and guide-way apertures. The catches and detents secure the hooks in both the open and closed positions, preventing accidental extension and retraction. The stops and guide apertures, which require greater force to override than do the catches and detents, prevent accidental removal and loss of the hooks. It will be appreciated that the retractable hooks, located in effect outside of the case of the binder, are totally independent of the binding mechanism, and consequently may be assembled and removed without operating the mechanism. The snap-in feature permits ready assembly of the binder and simple replacement of the head- and tail-end hooks.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

BRIEF DESCRIPTION OF THE DRAWINGS

For a fuller understanding of the nature and objects of the present invention, reference should be had to the following detailed description taken in connection with the accompanying drawings wherein.

As referred to herein, the spine of the binder is considered to be to the back, and the fore edge, to the front, of the binder, and these directions should not be confused with the "front" and "back" covers, which are the sides of the case respectively nearest the first and last pages of the document contained in the binder. Also as used herein, head and tail are respectively the directions toward the top and bottom of a side-edge-bound document.

In all figures, like numbers refer to like parts.

DETAILED DESCRIPTION

Figure 1:
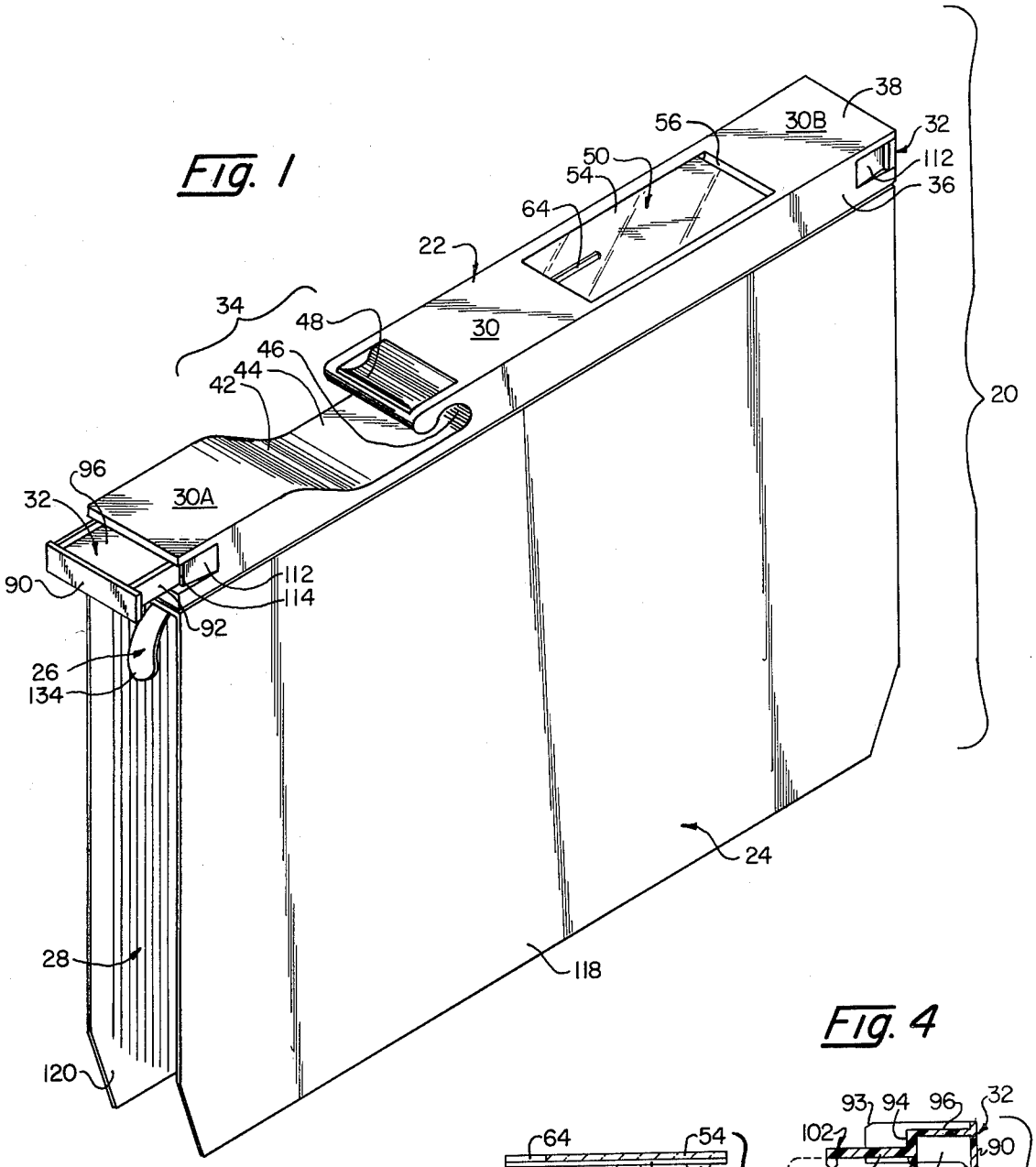
FIG. 1 is a perspective view of a binder made in accordance with the principles of the present invention, showing the spine, the tail edge, and the front cover.

Referring now in greater detail to the drawings, there is shown in FIG. 1 a binder 20 provided with a spine structure 22 made in accordance with the principles of the present invention. Binder 20 further comprises an articulated case 24 in which is disposed a multi-ring mechanism 26 suitable for the retention of marginally punched stationary items, as generally indicated by numeral 28. It will be appreciated that it is preferable for the heights (i.e., the head-to-tail dimensions) and the widths (i.e., the cover-to-cover dimensions) of spine structure 22 and case 24 to be substantially the same, and further that these dimensions are selected among other things on the basis of the dimensions of the multi-ring mechanism 28 to be accommodated within the closed (as illustrated) case. It is also necessary for the height of binder 20 to be smaller than the separation between the rails of the two-rail suspension system (not illustrated) with which it is to be used, and it is preferable, but not necessary, that it be less than the separation between rails of a standard-sized two-rail system by about 1 cm.

Spine structure 22 comprises an elongate spine piece 30 (to facilitate reference to the drawings in the following description, the portion of spine piece 30 nearest the preferred tail end is denoted 30A, and the portion adjacent the preferred head end, 30B) and a pair of retractable end pieces 32. As will be described hereinafter, end pieces 32 in their extended position may be used to support binder 20 in a two-rail suspension filing system (not shown). Preferably spine piece 30 is also provided with a hook, denoted generally by the numeral 34, which may be employed to secure binder 20 to a single-rail (a so-called "center rail") suspension system (not shown). Spine piece 30 and end pieces 32 may be fabricated out of any substantially rigid yet resiliently distortable material. By way of example, but not limitation, the spine piece and end pieces may be molded of a synthetic polymer such as medium- or high-density polyethylene, polystyrene, or the like.

Figure 4:
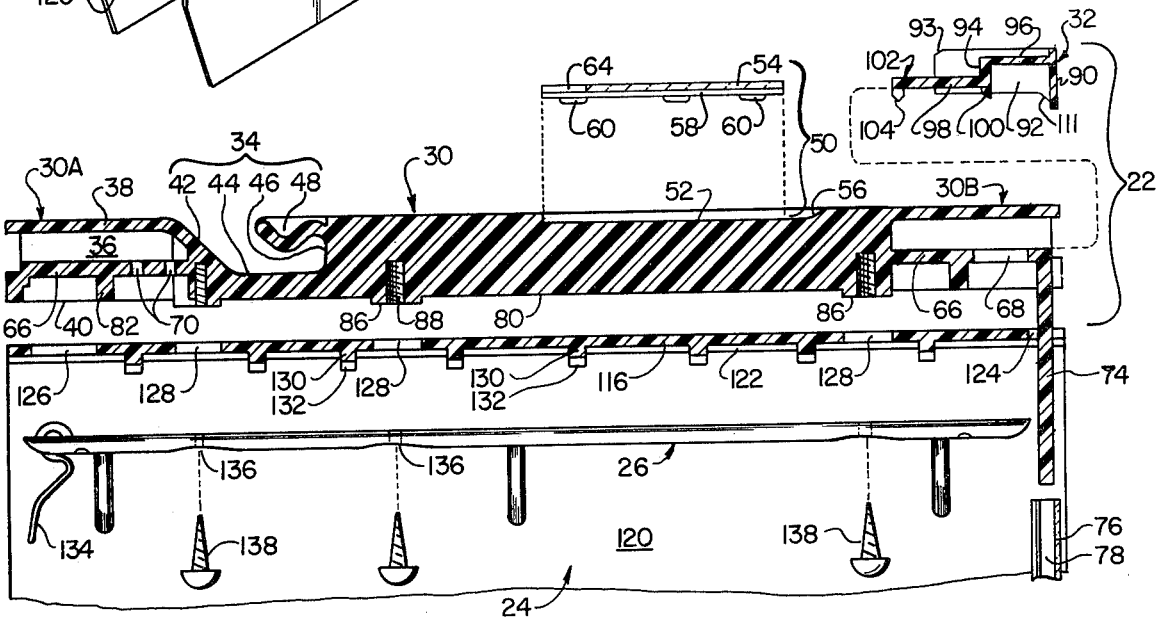
FIG. 4 is a fragmentary exploded sectional view of the binder of FIG. 1 taken along the line 4—4 of FIGS. 3 and 5.
Figure 3:
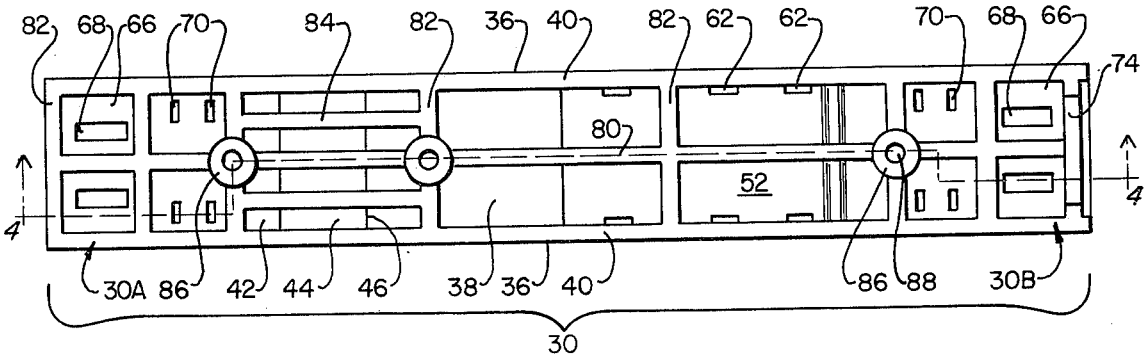
FIG. 3 is a front view of the spine piece of the binder of FIG. 1.

In greater detail, spine piece 30 is of open-ended partitioned channel form, as may be seen by reference to FIGS. 3 and 4. More particularly, spine piece 30 comprises a pair of mutually parallel relatively thin-walled planar sides 36 attached normal to the included relatively thin-walled planar back 38. In general outline, sides 36 and back 38 are each substantially rectangular, each long edge of the rectangle bounding back 38 being common with a long edge of a rectangle bounding the corresponding side 36. The corresponding short edges of each side 36 and back 38 are substantially coplanar. The long edges of each side 36 distal from back 38 are finished off in lips 40 which are substantially coplanar and equidistant from the plane of back 38. The length of back 38 and sides 36 of spine piece 30 are chosen to be substantially equal to the height of the particular binder 20 of which it is a part, while the width of the spine piece, from side to side, substantially defines the width of the binder. The depth of sides 36, as measured from back 38 to lips 40, is chosen to accommodate the structure described hereinafter, while the thicknesses of the walls constituting sides 36 and back 38 are substantially equal and are chosen on the basis of the strength of the material from which they are fabricated.

As noted hereinbefore, spine piece 30 is provided with hook 34. Hook 34 is preferably recessed into spine piece 30, interrupting back 38 and sides 36. Hook 34 comprises inclined wall section 42, wall sections 44 and 46, and hooked tab 48, as may be seen in FIGS. 1 and 4. Wall sections 42, 44, and 46 are planar walls extending substantially normal to and between and connecting sides 36. Inclined wall section 42 makes an angle, preferably 45 degrees as shown, to the plane of back 38; wall sections 44 and 46 are respectively disposed substantially parallel to and normal to back 38. Preferably hook 34 is disposed eccentrically along the length of spine piece 30, nearer to and opening toward tail end 30A of the spine piece. In such an embodiment, inclined wall section 42 joins back 38 along a line displaced toward tail end 30A of the spine piece, the inclined wall extending toward lips 40 of sides 36 the further the inclined wall section becomes from that end. Opposite inclined wall section 42, back 38 is interrupted by hooked tab 48, recessed beneath which (i.e., disposed from the tab in the direction of lips 40 and head end 30B of spine piece 30) is wall section 46. In the preferred embodiment, wall section 46 is also displaced from the center of back 38 toward tail end 30A of the spine piece, although it is nearer head end 30B than is inclined wall section 42. Both inclined wall section 42 and wall section 46 extend substantially equal distances from the plane of back 38 toward lips 40. Wall section 44 joins wall sections 42 and 46 at their furthest extent from back 38. Within the region bounded by wall sections 42, 44, and 46, sides 36 do not extend from lips 40 to back 38, but terminate instead at the wall sections, leaving an open undercut hooked tab 48 accessible from the sides as well as the back and tail end of spine piece 30. It will be understood that the disposition of wall sections 42, 44, and 46 and hooked tab 48 relative to one another must be such as to accommodate the supporting structure of the single-rail filing system with which spine piece 30 is to be used.

In a preferred embodiment, back 38 is provided with a label holder 50, shown in FIGS. 1 and 4. As may be seen in FIG. 4, label holder 50 comprises a recessed label support shelf 52 and a cover plate 54. Support shelf 52 is a substantially planar wall section parallel to the plane of back 38 and displaced from the back toward lips 40 by a distance somewhat less than the thickness of back 38. Support shelf 52 is of rectangular form, and, in a preferred embodiment extends substantially centrally along the head end portion 30B of spine piece 30 and between and joining sides 36. A rectangular opening opposite support shelf 52 is provided in back 38. Preferably the head end junction between support shelf 52 and back 38 is faired, providing a beveled surface 56 between the support shelf and the back. The remaining joins between back 38 and support shelf 52 may be substantially sharp angles.

Cover plate 54 is of transparent material, such as polycarbonate, polystyrene, acrylic, or other similar polymer, and is shaped and dimensioned to just cover support shelf 52, leaving a slight opening opposite beveled surface 56. Cover plate 54 is a thin planar plate with a substantially rectangular form, along the long sides of which are affixed spacers 58. Spacers 58 are thin marginal ribs providing slight clearance between cover plate 54 and support shelf 52, thereby allowing the insertion of a label (not shown) between the two. The thickness of cover plate 54 and spacers 58 are further chosen to place the surface of cover plate 54 furthest from support shelf 52 flush with the corresponding surface of back 38 when the cover plate is in place with spacers 58 resting on the support shelf. As an aid in assembling label holder 50, cover plate 54 is also provided with a set of tabs 60 projecting from spacer 58 away from the cover plate. Tabs 60 are attached to spacer 58 and are so dimensioned and disposed as to tightly fit into a series of similarly disposed and slightly smaller apertures 62 (shown in FIG. 3) in label support shelf 52. The tail end of cover plate 54 is cut through by a narrow slot 64 which substantially extends along the longitudinal axis of the cover plate. Preferably slot 64 has a length slightly in excess of the distance separating cover plate 54 from beveled surface 56. The width of slot 64 is chosen to permit access by a pointed instrument, such as a pencil point, to a label situated between cover plate 54 and support shelf 52.

Figure 5:
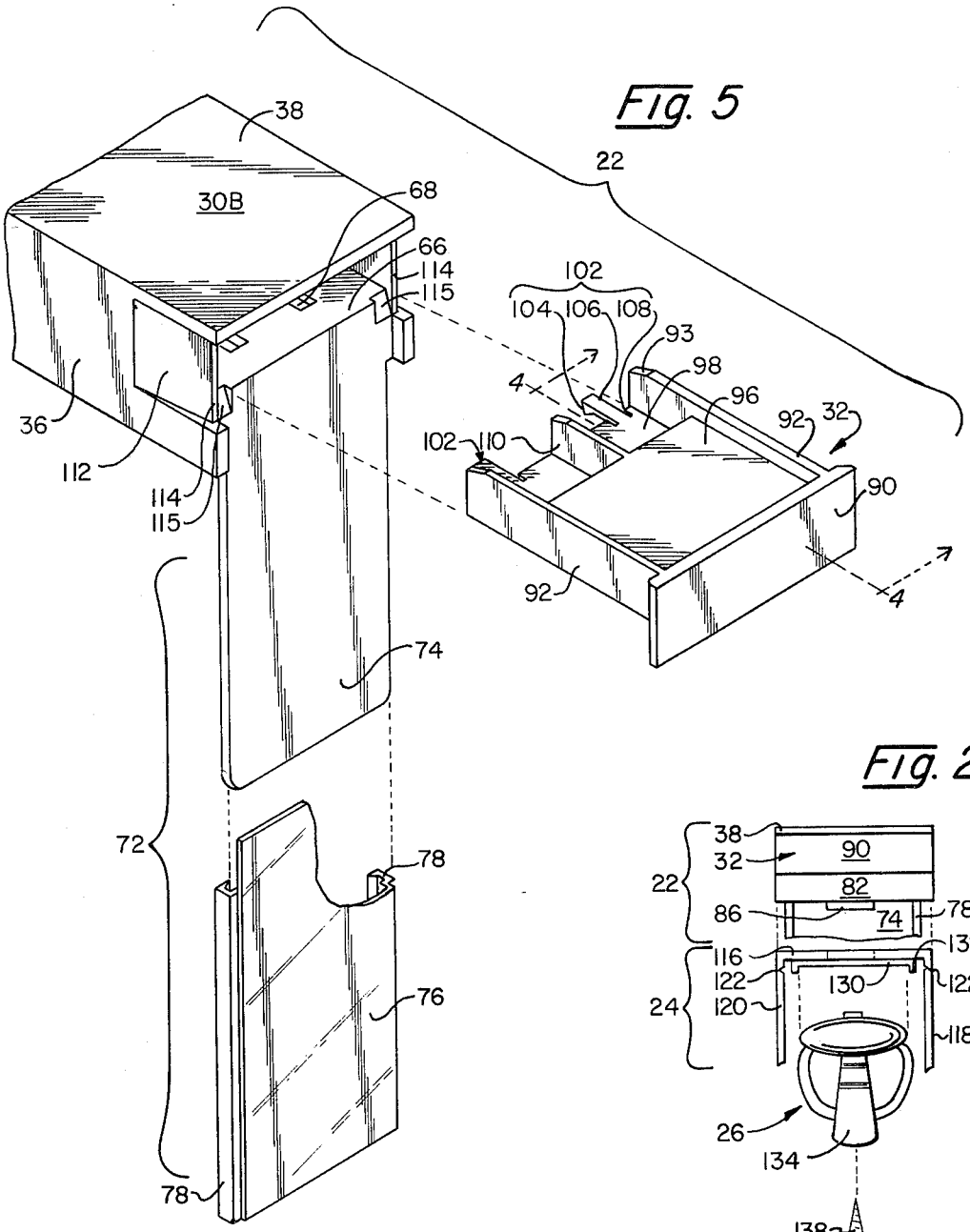
FIG. 5 is a fragmentary exploded perspective view of the head end portion of the spine of the binder of FIG. 1.

Each end of the interior of spine piece 30 is provided with an integral end shelf 66, best seen in FIGS. 4 and 5. Shelves 66 are both thin-walled planar sheets extending parallel to back 38 between sides 36 and longitudinally from the vicinity of the corresponding end of spine piece 30 toward the other end of the spine piece a distance sufficient to accommodate an end piece 32, as will be described. The distance of each end shelf 66 from back 38 is preferably on the order of half the distance from back 38 to lips 40. The end of each shelf nearest the corresponding end of spine piece 30 is offset toward the midpoint of the spine from the end by a distance on the order of the thickness of back 38.

Each end shelf 66 is provided with a pair of apertures 68 and a set of four detents 70, best seen in FIG. 3. Apertures 68 and detents 70 are rectangular openings penetrating through the end shelves. Apertures 68 and detents 70 are disposed symmetrically about the longitudinal axis of spine piece 30, with apertures 68 nearer the axis and detents 70 further therefrom. Each aperture 68 is centered about one quarter of the length of a shelf 66 from the end of the shelf nearest the corresponding end of spine piece 30, and in a preferred embodiment extends longitudinally along the shelf a distance on the order of 1 cm., the exact length depending upon the desired extension of end pieces 32 as will be described. The width of an aperture 68 is chosen to be on the order of the thickness of a shelf 66. Detents 70 are disposed in a rectangular array orthogonal to end shelves 66 and centered roughly in the half of each shelf remote from the nearest end of spine piece 30. The overall extent of each set of four detents in the direction parallel to the longitudinal axis of spine piece 30 is chosen to be on the order of the length of an aperture 68. In the other coordinated, the array is dimensioned so as to place detents 70 nearer sides 36 than are apertures 68. Each detent 70 extends normally to the longitudinal axis of spine piece 30 a distance on the order of the width of an aperture 68, while preferably the remaining dimension of each detent is chosen to be about half of this.

The ends of sides 36 and end shelves 66 of spine piece 30 are respectively provided with oblique sections 112 and recesses 115, as may best be seen in FIG. 5. Oblique sections 112 are planiform surfaces substantially normal to the plane of back 38 and cut into the interior surfaces of sides 36 in the vicinity of the head- and tail-ends. The surfaces of each oblique section 112 are inclined to the plane of the respective side so as to approach the longitudinal axis of spine piece 30 as the surface approaches the nearest head or tail end. Each oblique section 112 is spaced apart from the exterior surface of back 38 by a distance equal to the thickness of the back, and extends in the direction of lips 40 to just beyond the adjacent end shelf 66. Over the height of oblique section 112, the head- or tail-end of sides 36 are recessed, on the order of the thickness of back 38, toward the midpoint of spine piece 30 from the common plane normal to and defining the adjacent ends of sides 36 and back 38. The resulting displaced lips 114 are preferably chosen, by adjustment of the incline or oblique sections 112 to sides 36, to be no thinner than about one-half the nominal thickness of a side 36. The remaining dimension of an oblique section 112 is preferably chosen to be on the order of one to two centimeters, so as to easily accommodate a user's thumb- or finger-tip.

Recesses 115 are voids provided in end shelves 66 adjacent lips 114. Recesses 115 are in the form of right triangular prisms, the bases of which are isosceles right triangles. Recesses 115 are disposed with the bases of the prisms parallel to side 36, with the odd lateral face extending from the front to the back surface of end shelves 66 (i.e., from the surface nearer lips 40 to the surface nearer back 68) and with the equal lateral faces respectively in the plane of the back surface and in the corresponding head- or tail-end of the respective end shelf. The altitude of the prism is chosen to be on the order of the thickness of an end shelf 66.

As may be seen with reference to FIG. 5, head end 30B of spine piece 30 is provided with an end label holder, designated in general by numeral 72. End label holder 72 preferably comprises plate 74 and cover 76. Plate 74 is a thin, substantially planar rectangular extension of spine piece 30. Plate 74 is affixed to the head end of the shelf 66 nearest head end 30B of the spine piece and extends in a plane substantially orthogonal to shelf 66 and sides 36 so as to extend between the sides and away from the shelf in the direction away from back 30. Preferably, but not necessarily, the dimensions of plate 74 are similar to those of label support shelf 52, with like dimensions of each extending transverse to the longitudinal axis of spine piece 30. Cover 76 is dimensionally similar to plate 74 and is a substantially planar thin rectangular sheet of transparent material such as polycarbonate, polystyrene, acrylic, or the like. Affixed to cover 76 are a pair of guide channels 78. Guide channels 78 are of U-shaped cross section with an inside dimension selected to tightly fit the thickness of plate 74. Guide channels 78 are both affixed to the same surface of cover 76, extending substantially the length of the edges corresponding to the edges of plate 74 normal to shelf 66 and which extend beyond lips 40. Guide channels 78 are disposed parallel to one another and these edges of cover 76 with the open end of their U-shaped sections facing one another. The guide channels are spaced apart so as to tightly accommodate within the channels the dimension of plate 74 transverse the longitudinal axis of spine piece 30. Guide channels 78 are affixed to cover 76 by a side of the guide channels' U-shaped section, the side providing in effect a spacer between plate 74 and cover 76 when the latter is captively engaged to the former by the guide channel. A similar channel (not shown) may be disposed along one of the remaining edges of cover 76. The parallel guide channels 78 extend from this common edge toward the sole remaining edge of cover 76, terminating short of the remaining edge by a distance substantially equal to that separating shelf 66 and lips 40.

The interior of spine piece 30 is provided with a longitudinal reinforcing rib 80, a plurality of lateral reinforcing ribs 82, and a pair of auxiliary reinforcing ribs 84, as may be seen by reference to FIG. 3. Ribs 80, 82, and 84 are all thin substantially planar rectangular wall sections disposed normal to the plane of back 38 and extending from the plane of lips 40 of sides 36 toward the back, terminating variously at back 38, wall sections 42 and 44, label support shelf 52, and end shelf 66. Longitudinal reinforcing rib 80 extends along the longitudinal axis of spine piece 30 from plate 74 of label holder 72 to tail end 30A of the spine piece. Lateral reinforcing ribs 82 extend between and normal to sides 36 of spine piece 30. Lateral reinforcing ribs are preferably disposed at the tail end of the end shelf at the tail end 30A of spine 30 (extending from end shelf 66 toward lips 40); centrally on each end shelf; at the end of each end shelf 66 remote from the respective nearest end of spine piece 30 (extending from back 38 to lips 40, joining and reinforcing the end shelf); adjacent and toward the midpoint of spine 30 from wall section 46 of hook 34; and elsewhere, as required, as will be understood. Auxiliary reinforcing ribs 84 are disposed parallel to longitudinal reinforcing rib 80 and between the pair of lateral reinforcing ribs 82 adjacent and surrounding hook 34. Auxiliary reinforcing ribs 84 are disposed midway between longitudinal reinforcing rib 80 and sides 36.

A number of cylindrical posts 86, each provided with a blind axially tapped bore 88, are disposed at the intersections of longitudinal reinforcing rib 80 and selected lateral reinforcing ribs 82. Each post 86 is in the form of a right circular cylindrical structure the axis of which substantially coincides with the intersection of the midplanes of the respective reinforcing ribs. In a preferred embodiment, posts 86 are provided at the lateral reinforcing ribs 82 situated at the interior ends of end shelves 66 and at the lateral reinforcing rib adjacent wall section 46 of hook 34. Each post 86 extends the full depth (i.e., the distance from the respective end shelf 66, back 38, or inclined wall section 42 to the plane of lips 40) of the respective reinforcing ribs, and slightly beyond, as may be seen in FIGS. 2 and 4. The excess depth of a post 86 is on the order of the thickness of a wall section (e.g., as back 38).

Referring to FIGS. 4 and 5, there may be seen an end piece 32. Both end pieces 32 are similar in their constructional details, and consequently only one is illustrated in detail. Each end piece 32 is a drawer-like structure comprising end face 90, a pair of side walls 92, a cross-wall 94 (best seen in FIG. 4), and back and front walls 96 and 98 respectively. End face 90 is in the form of a thin, rectangular sheet, having a thickness on the order of that of back 38, and so dimensioned as to cover the opening framed by back 38, sides 36, and end shelf 66 of spine piece 30. To this end, the width of an end face 90 is chosen to be substantially the same as that of spine piece 30 (i.e., to be about the same as the overall width of the spine piece measured from one side 36 to another), and the height of an end face is chosen to be substantially that of the sum of the distance separating back 38 and an end shelf 66 plus the thickness of a shelf.

Affixed to end face 90 and extending in the same direction from and substantially normal to the plane thereof are side walls 92 and back wall 96. Side walls 92 and back wall 96 are in the form of thin, substantially rectangular sheets, the thicknesses of which are preferably similar to that of end face 90. Side walls 92 are disposed parallel to one another and to the edges of end face 90 which delimit the width of the end face. Each side wall 92 is displaced from the nearest parallel edge of end face 90 by a distance on the order of the thickness of a side 36. Side walls 92 are further disposed such that corresponding edges of each which are normal to end face 90 are coplanar with one another. One such pair of edges is further coplanar with an edge of end face 90. The side walls are so arranged that the long dimensions of their respective rectangular forms extend away from the end wall. This dimension is selected to be slightly less than the longitudinal dimension (with respect to spine piece 30) of an end shelf 66. The remaining dimension of each side wall 92 is selected to be slightly less than the separation between back 38 and an end shelf 66. As will be described, each end piece is intended to be captively movable over a range equal to the length of an aperture 68 in an end shelf 66, which in the preferred embodiment is on the order of 1 cm. It will be appreciated by those skilled in the art that, for reasons of stability, the overall length of a side wall 92 should be at least 1 cm. greater than whichever is the greater of the separation between back 38 and end shelf 66 or the separation between sides 36. Preferably this dimension is also chosen to be less than the greatest extent of an aperture 70 from the head- or tail-end of the corresponding head- or tail-end shelf 66. As an aid in assembly, side walls 92 may be provided with bevels 93, breaking the corners of the back edges (i.e., the edges coplanar with an edge of face plate 90) furthest from the face plate.

Back wall 96 is disposed normal to and between and joining side walls 92 adjacent the back edges of the side walls. Back wall 96 extends from end face 90 a distance equal to the greatest extent of an aperture 68 from the head- or tail-end of the corresponding head- or tail-end shelf 66.

Turning to FIG. 4, there may be seen cross wall 94. Cross wall 94 is a thin, substantially rectangular wall having a thickness similar to that of back and side walls 96 and 92 respectively. Cross wall 94 is disposed substantially normal to both back wall 96 and side walls 92. Cross wall 94 depends from back wall 96 toward the long edge of side walls 92 furthest therefrom, and extends between and joins the side walls. Cross wall 94 terminates at front wall 98, situated at about one wall thickness from the front edge of side walls 92. Front wall 98 is a thin, substantially rectangular wall of similar thickness as walls 92, 94, or 96. Front wall 98 is disposed parallel to back wall 96, and extends between and joins side walls 92. Front wall 98 extends from cross wall 94 away from end face 90 and terminates conterminous with side walls 92.

A pair of stops 100 project in the plane of cross wall 94 beyond the plane of front wall 98 (only one of the stops 100 is shown in the section depicted in FIG. 4). Stops 100 are symmetrically placed with respect to the midpoint of cross wall 94, and are spaced apart the same distance as are apertures 68 on end shelves 66. Stops 100 are small posts each of which extends across end piece 32 a distance slightly less than the width of an aperture 68. The portion of a stop 100 nearest end face 90 is dimensioned to extend away from front wall 98 beyond the plane defined by the nearest (i.e., the front) edges of side walls 92 a like distance. The front surfaces of stops 100 (i.e., the surfaces furthest from the intersection of cross wall 94 and front wall 98) are preferably beveled so as to approach front wall 98 the further they become from end face 90, becoming level with the plane of the front edges of side walls 92 at a distance from the front face on the order of the greatest distance of an edge of an aperture 68 from the head- or tail-end of the corresponding head- or tail-end shelf 66.

Each end piece 32 is also provided with a pair of spring catches 102, shown in FIGS. 4 and 5. Each spring catch 102 comprises a catch pin 104 and a spring tab 106. Spring tabs 106 are thin rectangular extensions of front wall 98, projecting parallel to one another in the plane of the front wall and away from end face 90. The thickness and width of each spring tab 106 is on the order of the thickness of front wall 98, and the greatest extent of a spring tab 108 from end face 90 is chosen to be equal to the greatest distance of the furthest edge of detents 70 from the head- or tail-end of the corresponding end shelf 66. Spring tabs 106 are disposed symmetrically about the longitudinal axis of end pieces 32 and are spaced apart a distance corresponding to the lateral separation between detents 70 in end shelves 66. The exact dimensions of each spring tab 104 are chosen, in view of the material of construction, to provide a resiliently deformable mounting for catch pins 104 which may be easily deflected a distance normal to the plane of front wall 98 slightly in excess of the thickness of the front wall. A pair of notches 108 (shown in FIG. 5), parallel to side walls 92, may be provided at the junction of each spring tab 106 to front shelf 98. Notches 108 provide for additional control of the resilient deformation of the spring tabs and provide stress control, as will be understood by those skilled in the art. Catch pins 104 are affixed to the end of each spring tab 106 remote from end face 90 so as to extend in the same direction, and by a similar amount, as do stops 100 from front wall 98. Catch pins 104 are dimensioned to fit detents 70 and are provided with a double bevel, the pin becoming shorter than its maximum height both toward and away from end face 90.

End piece 32 may additionally be provided with reinforcing wall 110 and reinforcing fillets 111. Reinforcing wall 110, shown in FIG. 5, is a thin rectangular wall parallel to side walls 92 and extending from cross wall 94 to the end of front wall 98, and from front wall 98 to the level of back wall 96. Reinforcing fillets 111, shown in FIG. 4, are small fillets of right trianglar prismatic form joining the front edges of walls 92 and the interior fore end surface of face plate 90. Reinforcing fillets are dimensioned to be slightly smaller than recesses 115 of end shelves 66.

Figure 2:
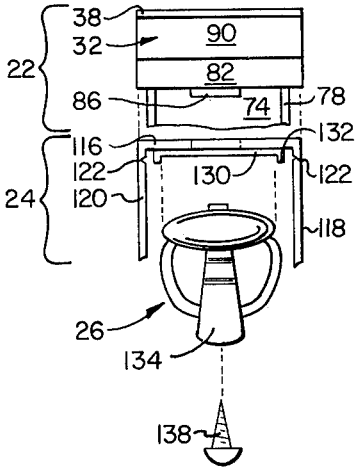
FIG. 2 is a fragmentary exploded tail end view of the binder of FIG. 1.

Case 24 comprises front and rear covers, 118 and 120 respectively, joined to opposite sides of an included spine 116 by a pair of parallel hinges 122, all of which may be seen in section in FIG. 2. Preferably, spine 116, covers 118 and 120, and hinges 122 are of unitary construction, being molded in one piece from polypropylene, polyethylene, or a similar flexible polymer, the thickness of each portion being controlled so as to result in stiff covers, a relatively rigid spine, and flexible hinges. In a preferred embodiment, hinges 122 are formed as grooves of V-shaped cross section disposed on the interior of case 24 adjacent spine 116, as may be seen in FIG. 2. In this embodiment, the grooves are so dimensioned as to provide a hinge with free outward yet limited inward flexure. Such a construction permits front and rear covers 118 and 120 to freely open outward, yet restricts their inward closed position to being parallel to one another and normal to spine 116, as illustrated. It will be appreciated that so limiting the closing of covers 118 and 120 facilitates the shelving or filing of binder 20 and also protects bound stationery items 28 from chafing between the rings of multi-ring mechanism 26 and the covers in an improperly closed binder. It will be appreciated, however, that other materials and methods of fabrication can be used for the case. Thus, for instance, hinges 122 can be individual double leaf hinges bonded, as by rivets, to individually formed covers 118 and 120 and spine 116.

The principal difference between case 24 and conventional cases is in the structure of spine 116, which is provided with a number of openings, variously designated in FIG. 4 by numerals 124, 126, and 128. Spine 116 is also provided with a series of transverse ribs 130 and posts 132.

Considering first the openings, they are head-end notch 124, tail-end slot 126, and apertures 128. Head-end notch 124 is a rectangular opening recessed through the head end of spine 116 and extending across the width of the spine between the abutments of the spine with hinges 122 and from the head end of the case toward the tail end by a distance on the order of three time the width of plate 74 of end label holder 72. The exact dimensions of head-end notch 124 are chosen to accommodate label holder 72 in the fully assembled binder 20, the label holder and its cover passing through the head-end notch when spine piece 30 is positioned on spine 116 with lips 40 of sides 36 in contact with the spine and parallel and adjacent hinges 122, and with the corresponding head- and tail-ends of spine 116 and spine piece 30 conterminous. Tail-end slot 126 is a longitudinal axial rectangular opening through the tail end of spine 116. Tail-end slot 126 is dimensioned and disposed to provide clearance for the lever mechanism 134 of multi-ring mechanism 26 when the latter is assembled into binder 20 as will be described. Apertures 128 are circular apertures penetrating through spine 116 and situated along its longitudinal axis. Apertures 128 are dimensioned and disposed to tightly fit the portions of posts 86 which extend beyond the plane of lips 40 of spine piece 30 when the spine piece is assembled onto spine 116, with lips 40 of walls 36 parallel and adjacent hinges 122 and corresponding head- and tail-ends of spine piece 22 and spine 116 conterminous.

Affixed to the front surface of spine 116 (i.e., the interior surface of spine 116 with regard to the closed case 24) are a plurality of transverse ribs 130, shown in section in FIG. 4 and in transverse elevation in FIG. 2. Transverse ribs 130 are symmetrically disposed about the longitudinal axis of spine 116 at intervals from near the head- to near the tail-end of the spine. Transverse ribs 130 are configured and dimensioned to support multi-ring mechanism 26 in position on spine 116. To this end, the extremes of each transverse rib 130 are preferably provided with short locating posts 132 spaced apart by the width of multi-ring mechanism 26. Transverse ribs 130 are disposed along the length of spine 116 so as to support the entire length of the multi-ring mechanism. It will be understood that transverse ribs 130 are so disposed as to remain clear of tail end slot 126 and apertures 128.

Multi-ring mechanism 26 is a conventional multi-ring mechanism. Preferably it is of the type in which the rings may be opened and closed by a single actuating lever 134, which also serves to lock the mechanism in the closed position, although it will be appreciated that other types of mechanism could be employed. Thus, for instance, multi-ring mechanism 26 may be a non-lever-actuated mechanism. In the event binder 20 is not to be provided with a head end label holder 72, the multi-ring mechanism may also be a double-lever mechanism. In a preferred embodiment, the binder is provided with a head end label holder and a single-lever type of multi-ring mechanism, mechanism 26 being positioned such that lever 134 is at the tail end of binder 20.

Multi-ring mechanism 26 differs from conventional multi-ring mechanisms in that it is provided with a number of specially disposed apertures 136. Apertures 136 are situated along the longitudinal axis of multi-ring mechanism 26, and penetrate through the mechanism. Apertures 136 are disposed with respect to one another and with respect to the longitudinal midpoint of multi-ring mechanism 26 in the manner bores 88 in posts 86 are to each other and to spine piece 30. Apertures 136 are dimensioned to accept screws 138. Screws 138 are tapped to fit bores 88 and are of a length to secure multi-ring mechanism 26 to spine piece 22 with spine 116 of case 24 captivated therebetween, as will be described in greater detail hereinafter.

Assembly and operation of binder 20 will now be described.

Spine piece 30 is assembled to case 24 with lips 40 of sides 36 of the spine piece parallel to hinges 122 and in contact with the back (i.e., the exterior) of spine 116 of the case and with end label holder 72 passing through head end notch 124. Each post 86 of spine piece 30 is aligned with and passed through an aperture 128 of case 24. Multi-ring mechanism 26 is positioned in case 24 with the back of the ring mechanism parallel to spine 116 and resting on transverse ribs 130 between locating posts 132. Actuating lever 134 is positioned opposite tail end slot 126 and apertures 136 are positioned opposite tapped bores 88 in posts 86. The assembly of spine piece 30, case 24, and multi-ring mechanism 26 is completed by screws 138 passing through apertures 136 and secured in tapped bores 88 of posts 86.

It will be appreciated that in effecting this assembly, the fit between posts 86 of spine piece 30 and apertures 128 of spine 116 and between locating posts 132 of spine 116 and multi-ring mechanism 26 cooperate to assure proper alignment of the components. This fit not only facilitates assembly but also assures security of the alignment of the components once assembled. Locating posts 132 also function to prevent the lateral spreading of multi-ring mechanism 26 under compression, as by screws 138. It will be understood by those skilled in the art that such spreading might defeat the mechanism of multi-ring mechanism 26, inadvertently releasing stationery items 28. Preventing this compressionally induced spreading is important in the present design, as the positioning of apertures 136 away from the extremities of the multi-ring mechanism (where attachments are normally positioned) defeats the restaint against compression afforded by the normally reinforced ends of the mechanism. However, this placement of apertures 136 permits screws 138 and posts 86 to be placed beyond shelves 66, thereby avoiding interference with the operation of end pieces 32, and also permits the structure of multi-ring mechanism 26 to be used as reinforcement for spine piece 32, particularly in the region surrounding hook 34. These features of the present design in turn permit a more shallow spine piece 30 (i.e., a spine piece having minimal dimension between back 38 and lips 40), which in turn permits binder 20 to be opened relatively flat, facilitating its use.

In a fully assembled spine structure 22, head- and tail-end, 30B and 30A respectively, of spine piece 30 are each provided with an end piece 32. End pieces 32 fit drawer-like into the apertures formed by back 38, sides 36, and end shelves 66. The end pieces are assembled to the spine piece with side walls 92 in movable confronting contact with sides 36, back walls 96 parallel to and confronting back 38, front walls 98 parallel to and confronting end shelves 66, and spring catches 102 nearer the midpoint of the spine piece than are end faces 90. Assembly is effected by merely inserting the end pieces 32, so oriented, into spine piece 30. The extension of catch pins 104 and spring tabs 106 beyond the side and front walls, 92 and 98 respectively, and the slight bevels 93 on the side walls facilitate this insertion. As the full height of sides 92 come between back 38 and end shelf 66, catch pins 104 are forced into contact with end shelf 66, and the resilient deformation of spring tabs 106, permits the catch pins to be deflected toward back 30, providing the necessary clearance for further insertion of the end piece. As stops 100 encounter end shelf 66, resilient deformation of both end shelf 66 and end piece 32, assisted by the wedge-like action provided by the preferred beveled shape of stops 100, permits the stops to override the end shelf. Further insertion of end piece 32 brings stops 100 opposite apertures 68 just as catch pins 104 come opposite the detents 70 nearest the apertures. Elastic restoring forces in the deformed end piece and shelf and in the deformed spring tabs respectively now force stops 100 into apertures 68 and catch pins 104 into detents 70. End piece 32 is now releasably secured in its extended position, as illustrated in FIG. 1 for the end piece at tail end 30A of spine piece 30. In the preferred embodiment, the dimensions and disposition of apertures 68, detents 70, stops 100, and catch pins 104 result in an extended position for each end piece 32 wherein end faces 90 are about 1 cm. from lips 114.

Further insertion of end piece 32 is accomplished by supplying sufficient inward force to the end piece to force catch pins 104, through the resilient deformation of spring tabs 106, toward back 38, thereby causing the catch pins to ride up onto end shelf 66 and escape detents 70 nearest apertures 68. The beveled faces of catch pins 104 remote from end face 90 serve as wedges to effect this release. Further inward motion of the end piece translates stops 100, which are now slidably captivated in apertures 68, along the apertures until they reach the ends of the apertures nearest the midpoint of spine piece 30. This occurs just as catch pins 104 come opposite the innermost set of detents 70. At this point, relaxation of spring tabs 106 captivates catch pins 104 in the innermost set of detents 70, releasably securing end piece 32 in its closed position, as illustrated in FIG. 1 for the end piece at the head end 30B of spine piece 30. In this position, end face 90 of the end piece is in contact with lips 114 on the spine piece, recesses 115 on the spine piece having accommodated reinforcing fillets 111 on the end piece. End face 90 is now recessed under and flush with the end back 38 of the spine piece.

It will be appreciated that the assembly of end piece 32 into spine piece 30 may be performed either before or after assembly of spine piece 30, case 24, and multi-ring mechanism 26.

In use, end pieces 32 can be extended by reversing the procedure previously described. That is, end pieces 32 can be withdrawn from their closed position, wherein end faces 90 are in contact with lips 114 of spine piece 30, by a longitudinally outward pull, the resilient deformation of spring tabs 106 permitting catch pins 104 to override the detents 70 furthest from the respective head- or tail-end of the corresponding end shelf 66. This action is facilitated by the provision of oblique sections 112 which permit a user to easily grasp end faces 90 when end pieces 32 are in their closed position. Extension can proceed until stops 100 contact the respective head- or tail-ends of apertures 68 of the corresponding end shelf 66 and catch pins 104 simultaneously are forced into the respective head- or tail-end detents 70. In the preferred embodiment, this results in an extension of each end piece (as shown in FIG. 1 for the end piece at tail end 30A of spine piece 30) of approximately 1 cm. A rail of a two-rail suspension file system (not shown) can now be engaged between the respective head- or tail-end of spine piece 30 and the corresponding end face 90, the forward projection of the end face beyond side walls 92 serving to captivate the respective rail in supporting contact with the side walls. Reinforcing fillets 111 not only provide reinforcement but are also of use in centering end pieces 32 on the supporting rails, thereby disposing binder 20 more nearly centrally between the rails.

Detents 70, interacting with catch pins 104, serve to determine the location of end pieces 32 in either the extended or closed position. As a consequence, the probability of accidental retraction of an end piece through inadvertant contact is reduced. Stops 100 cooperating with apertures 68 serve to releasably captivate end pieces 32 to spine piece 30. While an end piece may be removed by resiliently distorting the end piece and the corresponding end shelf 66, it will be understood that the resilient deformation of spring tabs 106 requires much less force than that of end shelf 66 and end piece 32. Further, the shape of stops 100 as compared to catch pins 104 does not contribute leverage to the resilient deformation of shelf 66 and end piece 32 except in the installation of an end piece. Consequently, while end pieces 32 may be readily installed and thereafter easily moved between their closed and extended positions, a considerably greater force is required to distort an end piece and a shelf 66 in order to remove an end piece. This feature prevents inadvertent removal, with a consequent danger of loss, of an end piece, yet still allows their removal and replacement without the need to disassemble binder 20 or remove the document bound therein.

Binder 20 may also be attached to a single-rail suspension system by engaging hook 34 with the single suspension rail (not shown). The eccentric location of hook 34 may be used to positively locate the binder in a single-rail system of the type of the type providing an additional locating shelf or bar, as is well known in the art.

Label cards (not illustrated) may be inserted into label holders 50 and 72. In the former, which is of use particularly with a two-rail suspension file or with standard library-type shelving, the cards may be inserted through the aperture between cover plate 54 and beveled surface 56, the label when fully inserted being positioned between label support shelf 52 and cover plate 54. A sharp instrument, such as a pencil tip, may be used as an aid in removing this label, the tip of the sharp instrument gaining a purchase on the tail end of the label through slot 64. Label holder 72 is of particular use with single-rail suspension files. In its case, cover 76 is detacably affixed to plate 74 by guide channels 78. Guide channels 78 tightly fit about opposite side edges of plate 74 yet permit the cover to be slid forward, away from shelf 66, on the plate. The dimensions and placement of guide channels 78 are selected to offer sufficient friction to inhibit the accidental movement of the cover but permit intentional motion. By partially removing cover 76, access may be gained to plate 74 in order to insert or remove a label card, after which cover 76 may be returned to its full rearward (i.e., toward shelf 66) position, securing and protecting the label.

It will be apparent that the invention herein described is susceptible of being practiced otherwise than is herein illustrated. For example, there need not be only one hook 34, nor need a single hook 34 be eccentrically located. Further, as already noted, case 24 need not be of unitary construction, but might be assembled from separate parts. It will also be appreciated that the functions of end shelves 66 could be incorporated into spine 116 of case 24, the spine being provided with apertures and detents and supporting the head end label holder. Since these and other changes may be made in the above described apparatus without departing from the scope of the invention herein involved, it is intended that all matter contained in the above description or shown in the accompanying drawings shall be interpreted in an illustrative and not a limiting sense.

What is claimed is:

1. A loose-leaf binder for use in both single- and double-horizontal-rail filing systems said binder comprising in combination:

means for releasably securing marginally perforated stationary items;

an articulated case comprising front and rear covers hinged to an included elongate spine, said spine terminating longitudinally in head- and tail- ends and being dimensioned to accommodate within said case said items securing means, and support means on said spine for aligning and laterally restraining said items securing means; and an elongate hollow spine structure of similar length and width as said case spine and similarly terminating in head- and tail-ends, said spine structure comprising a pair of substantially parallel sides and an included back, hook means, and end means, said hook means comprising at least one hook formed in said back and said sides, and said end means including a pair of end pieces disposed at said head- and tail-ends of said spine structure with at least one of said end pieces being movable between a closed position and an opened position relative to said spine, when in said closed position said at least one end piece being fully recessed within said spine structure so as to not substantially extend beyond the associated head- or tail-end thereof, and when in said opened position said at least one end piece extending longitudinally beyond the associated head- or tail-end, said end means being further provided with means for releasably securing said end pieces in said opened position and said closed position; and means, separate from and operable independently of the end pieces, for securing the case to the spine structure;

whereby the binder may be suspended by said end pieces in the double-horizontal-rail filing system or by said hook in the single-horizontal-rail filing system.

2. A loose-leaf binder according to claim 1 wherein both of said end pieces are movable between said opened and closed positions, and further said end means includes a pair of shelves parallel to said back and connecting said sides and disposed internally at either of said ends of said spine structure and so dimensioned as to support drawer-like said retractable end pieces.

3. A loose-leaf binder according to claim 2 wherein further said means for releasably securing comprises a plurality of detents and corresponding spring catches.

4. A loose-leaf binder according to claim 3 wherein said plurality of detents are disposed on said shelves and said spring catches are disposed on said end pieces.

5. A loose-leaf binder according to claim 1 wherein the items securing means includes a multi-ring binder.

6. A loose-leaf binder according to claim 1 wherein the releasably securing means is a multi-ring mechanism and the case securing means includes locating means providing lateral alignment between said spine and said spine structure and longitudinal alignment between said multi-ring mechanism, said spine, and said spine structure so as to substantially confine said multi-ring mechanism between said head- and tail-ends and so position said sides remote from said back on said spine as to bring said spine and said spine structure into substantially conterminous confronting relationship.

7. A loose-leaf binder for use in both single- and -horizontal-rail filing systems, said binder comprising in combination:

a multi-ring mechanism suitable for releasably securing marginally perforated stationery items;

an articulated case comprising front and rear covers hinged to an included elongated spine, said spine terminating longitudinally in head- and tail-ends and being dimensioned to accommodate within said case multi-ring mechanism, and support means on said spine for aligning and laterally restraining said multi-ring mechanism;

an elongate hollow spine structure of similar length and width as said spine and similarly terminating in head- and tail-ends, said spine structure comprising a pair of substantially parallel sides and an included back, hook means, and end means, said hook means comprising at least one hook formed in said back and said sides and dimensioned to accept a rail of said single-horizontal-rail filing system, and said end means including a pair of retractable end pieces disposed at said head- and tail-ends of said spine structure so as to be movable between a closed position and an opened position relative to said spine, said closed position being characterized by said end pieces being fully recessed within said spine structure so as to not extend beyond the head- and tail-ends thereof, and said opened position being characterized by said end pieces extending longitudinally beyond said head- and tail-ends by a distance at least as great as that separating said horizontal rails in said double-horizontal-rail filing system, said end means being further provided with means for releasably securing said end pieces in said opened position and said closed position; and locating means providing lateral alignment between said spine and said paine structure and longitudinal alignment between said multi-ring mechanism, said spine, and said spine structure so as to substantially confine said multi-ring mechanism between said head- and tail-ends and so position said sides remote from said back on said spine as to bring said spine and said spine structure into substantially conterminous confronting relationship, said end means includes a pair of shelves parallel to said back and connecting said sides and disposed internally at either of said ends of said spine structure and so dimensioned as to support drawer-like said retractable end pieces;

said means for releasably securing comprises a plurality of detents and corresponding spring catches, said end pieces are removable from said spine structure by longitudinally extending said end pieces beyond said opened position, and wherein said end pieces and said spine structure are provided with a defeatable stop means to prevent accidental extension beyond said opened position.

8. A loose-leaf binder according to claim 7 wherein further said defeatable stop means comprises at least one stop pin on each said end piece and corresponding apertures on said shelves, said apertures limiting the motion of said stop pins to be between said opened position and said closed position, and wherein said stop means is defeated by resiliently distorting said end pieces and said spine structure.

9. A loose-leaf binder for use in both single- and double-horizontal-rail filing systems, said binder comprising in combination:

a multi-ring mechanism suitable for releasably securing marginally perforated stationery items;

an articulated case comprising front and rear covers hinged to an included elongated spine, said spine terminating longitudinally in head- and tail-ends and being dimensioned to accommodate within said case said multi-ring mechanism, and support means on said spine for aligning and laterally restraining said multi-ring mechanism;

an elongate hollow spine structure of similar length and width as said spine and similarly terminating in head- and tail-ends, said spine structure comprising a pair of substantially parallel sides and an included back, hook means, and end means, said hook means comprising at least one hook formed in said back and said sides and dimensioned to accept a rail of said single-horizontal-rail filing system, and said end means including a pair of retractable end pieces disposed at said head-and tail-ends of said spine structure so as to be movable between a closed position and an opened position relative to said spine, said closed position being characterized by said end pieces being fully recessed within said spine structure so as to not extend beyond the head- and tail-ends thereof, and said opened position being characterized by said end pieces extending longitudinally beyond said head- and tail-ends by a distance at least as great as that separating said horizontal rails in said double-horizontal-rail filing system, said end means being further provided with means for releasably securing said end pieces in said opened position and said closed position; and locating means providing lateral alignment between said spine and said spine structure and longitudinal alignment between said multi-ring mechanism, said spine, and said spine structure so as to substantially confine said multi-ring mechanism between said head- and tail-ends and so position said sides remote from said back on said spine as to bring said spine and said spine structure into substantially conterminous confronting relationship;

said item securing means includes a multi-ring mechanism and said locating means comprises a plurality of posts disposed on said back, a corresponding plurality of first apertures in said spine, a like plurality of second apertures in said multi-ring mechanism, and a plurality of fastening means, said posts being dimensioned and disposed to extend from said back a distance greater than do said sides, said first apertures being dimensioned to fit said posts, said second apertures being smaller than said first apertures, and said fastening means being dimensioned to partially pass through said second apertures and penetrate said posts thereby captivating said multi-ring mechanism to said spine structure with said case tightly sandwiched therebetween.

10. A loose-leaf binder according to claim 9 wherein further ones of said posts are disposed along a longitudinal axis of said back so as to be remote from said ends, adjacent said end means, and surround said hook.

11. A loose-leaf binder for use in both single- and double-horizontal-rail filing systems, said binder comprising in combination:

a multi-ring mechanism suitable for releasably securing marginally perforated stationery items;

an articulated case comprising front and rear covers hinged to an included elongated spine, said spine terminating longitudinally in head- and tail-ends and being dimensioned to accommodate within said case said multi-ring mechanism, and support means on said spine for aligning and laterally restraining said multi-ring mechanism;

an elongated hollow spine structure of similar length and width as said spine and similarly terminating in head- and tail-ends, said spine structure comprising a pair of substantially parallel sides and an included back, hook means, and end means, said hook means comprising at least one hook formed in said back and said sides and dimensioned to accept a rail of said single-horizontal-rail filing system, and said end means including a pair of retractable end pieces disposed at said head-and tail-ends of said spine structure so as to be movable between a closed position and an opened position relative to said spine, said closed position being characterized by said end pieces being fully recessed within said spine structure so as to not extend beyond the head- and tail-ends thereof, and said opened position being characterized by said end pieces extending longitudinally beyond said head- and tail-ends by a distance at least as great as that separating said horizontal rails in said double-horizontal-rail filing system, said end means being further provided with means for releasably securing said end pieces in said opened position and said closed position; and locating means providing lateral alignment between said spine and said spine structure and longitudinal alignment between said multi-ring mechanism, said spine, and said spine structure so as to substantially confine said multi-ring mechanism between said head- and tail-ends and so position said sides remote from said back on said spine as to bring said spine and said spine structure into substantially conterminous confronting relationship;

said end means includes a pair of shelves parallel to said back and connecting said sides and disposed internally at either of said ends of said spine structure and so dimensioned as to support drawer-like said retractable end pieces;

said spine piece is provided with a first and a second label holder, said first label holder comprising a shelf parallel to and recessed into said back and a parallel transparent cover flush with said back, and said second label holder comprising a rectangular plate extending substantially normal to one of said shelves situated at said head end of said spine structure and away from said back, said plate being substantially in the plane of said head end and having a width less than that of said spine, so as to extend between said front and rear covers.

12. A loose-leaf binder according to claim 11 wherein further said second label holder is provided with a slip-on cover.

13. A loose-leaf binder according to claim 12 wherein further said spine is provided with a clearance notch to accommodate said second label holder.

* * * * *